US010625110B2

(12) United States Patent
Henneberry

(10) Patent No.: US 10,625,110 B2
(45) Date of Patent: Apr. 21, 2020

(54) GARMENT INCLUDING LIQUID WEIGHT RESISTANCE

(71) Applicant: UWM Research Foundation, Inc., Milwaukee, WI (US)

(72) Inventor: Chad Henneberry, Milwasukee, WI (US)

(73) Assignee: UWM Research Foundation, Inc., Milwaukee, WI (US)

( * ) Notice: Subject to any disclaimer, the term of this patent is extended or adjusted under 35 U.S.C. 154(b) by 100 days.

(21) Appl. No.: 15/838,645

(22) Filed: Dec. 12, 2017

(65) Prior Publication Data

US 2018/0161616 A1 Jun. 14, 2018

Related U.S. Application Data

(60) Provisional application No. 62/434,267, filed on Dec. 14, 2016.

(51) Int. Cl.
*A63B 21/065* (2006.01)
*A63B 21/06* (2006.01)

(52) U.S. Cl.
CPC ..... *A63B 21/065* (2013.01); *A63B 21/06* (2013.01); *A63B 21/0602* (2013.01)

(58) Field of Classification Search
CPC .... A63B 21/06; A63B 21/0602; A63B 21/065
See application file for complete search history.

(56) References Cited

U.S. PATENT DOCUMENTS

| | | | | |
|---|---|---|---|---|
| 4,344,620 | A | 8/1982 | Debski | |
| 4,384,369 | A * | 5/1983 | Prince | A63B 21/065 2/227 |
| 4,951,940 | A * | 8/1990 | Vitello | A63B 21/0602 224/148.1 |
| 4,988,093 | A * | 1/1991 | Forrest, Sr. | A63B 21/0602 2/413 |
| 5,072,935 | A * | 12/1991 | McWain | A63B 21/0602 224/148.1 |
| 5,938,089 | A | 8/1999 | Abreu-Marston | |
| 6,209,135 | B1 | 4/2001 | Irvin | |
| 6,669,608 | B1 | 12/2003 | Winston | |
| 6,675,391 | B2 | 1/2004 | Morrison | |
| 2002/0010058 | A1 * | 1/2002 | Myrick | A63B 21/065 482/92 |
| 2003/0177984 | A1 * | 9/2003 | Newman | A01K 13/006 119/850 |
| 2015/0196790 | A1 | 7/2015 | Escueta | |

FOREIGN PATENT DOCUMENTS

| | | |
|---|---|---|
| CN | 203425449 | 2/2014 |

* cited by examiner

*Primary Examiner* — Jennifer Robertson
(74) *Attorney, Agent, or Firm* — Michael Best & Friedrich LLP

(57) ABSTRACT

A garment including a garment body configured to be wearable by a person. The garment also includes a first tube selectively coupled to the garment body. The first tube is configured to receive a first desired amount of liquid through a first opening of the first tube. The garment further includes a second tube selectively coupled to the garment body independently of the first tube. The second tube is configured to receive a second desired amount of liquid through a second opening of the second tube. The second tube is fluidly distinct from the first tube.

16 Claims, 9 Drawing Sheets

GARMENT INCLUDING LIQUID WEIGHT RESISTANCE

CROSS-REFERENCE TO RELATED APPLICATIONS

This application claims priority to U.S. Provisional Patent Application No. 62/434,267, filed Dec. 14, 2016. The contents of which are incorporated herein by reference.

FIELD OF THE DISCLOSURE

The present disclosure relates to garments including weight resistance, and more particularly to garments including liquid weight resistance.

SUMMARY

In one aspect, a garment includes a garment body configured to be wearable by a person. The garment also includes a first tube selectively coupled to the garment body. The first tube is configured to receive a first desired amount of liquid through a first opening of the first tube. The garment further includes a second tube selectively coupled to the garment body independently of the first tube. The second tube is configured to receive a second desired amount of liquid through a second opening of the second tube. The second tube is fluidly distinct from the first tube.

In another aspect, a garment is configured to be wearable by a person. The garment includes a vest body having a right front portion, a left front portion, and a back portion. The garment also includes a first flexible tube coupled to the vest body and extending from the right front portion across the back portion to the left front portion of the vest body. The first flexible tube is configured to receive a first desired amount of liquid through a first opening of the first flexible tube. The garment further includes a second flexible tube coupled to the vest body and extending from the right front portion across the back portion to the left front portion of the vest body. The second flexible tube is configured to receive a second desired amount of liquid through a second opening of the second flexible tube. The second flexible tube is fluidly distinct from the first flexible tube. The first flexible tube defines a first cross sectional profile perpendicular to a first central longitudinal axis of the first flexible tube, wherein the first cross sectional profile is substantially unchanged between when the first desired amount of liquid is received within the first flexible tube and when the first flexible tube is empty. The second flexible tube defines a second cross sectional profile perpendicular to a second central longitudinal axis of the second flexible tube, wherein the second cross sectional profile is substantially unchanged between when the second desired amount of liquid is received within the second flexible tube and when the second flexible tube is empty.

Other aspects of the disclosure will become apparent by consideration of the detailed description and accompanying drawings.

DETAILED DESCRIPTION

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings. Terms of degree, such as "substantially" or "approximately" are understood by those of ordinary skill to refer to reasonable ranges outside of the given value, for example, general tolerances associated with manufacturing, assembly, and use of the described embodiments. For example, "substantially" can be defined as being within about 5 percent to about 10 percent of a given value.

Figure 1:
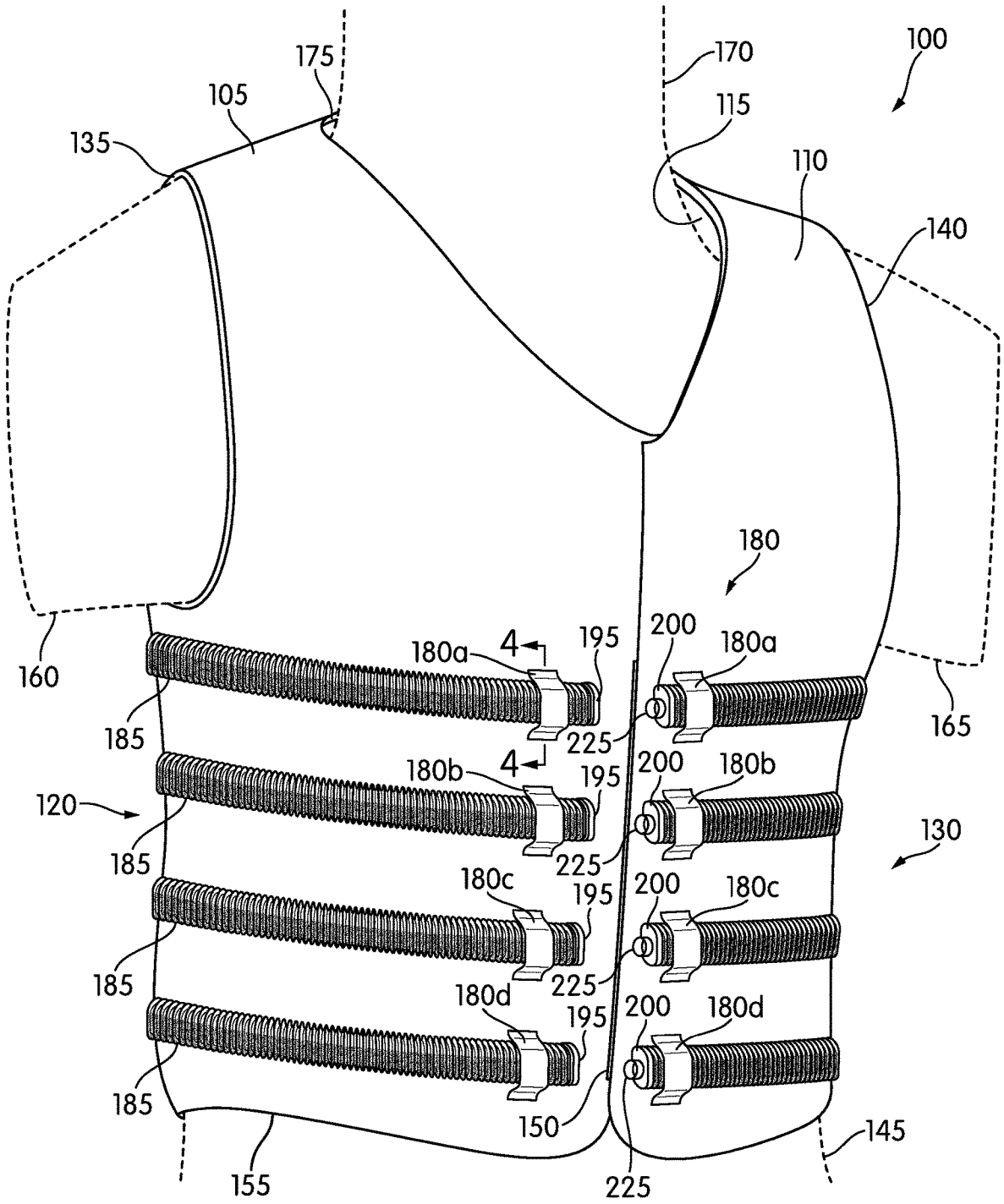
FIG. 1 is a front perspective view of a weighted garment wearable about a torso of a person according to one embodiment of the disclosure.

FIG. 1 illustrates a weighted garment 100 (i.e., a weighted vest) including a vest body 105 having an outer surface 110 and an inner surface 115 with the surfaces 110, 115 defining a right front portion 120, a back portion 125 (FIG. 2), and a left front portion 130 of the vest body 105. The vest body 105 also includes a right arm opening 135 and a left arm opening 140. When the garment 100 is worn by a person, the vest body 105 wraps around a torso 145 of the person for an end of the right front portion 120 and the left front portion 130 to be selectively coupled together by a coupling mechanism 150 (e.g., a zipper, snap buttons, hook and loop fasteners, buckles, clasps, or the like) to secure the garment 100 to the torso 145. As such, a bottom portion of the person's torso 145 extends through a lower torso opening 155 of the vest body 105, a right arm 160 of the person extends through the right arm opening 135, a left arm 165 of the person extends through the left arm opening 140, and a neck 170 of the person extends through a neck opening 175 of the vest body 105. In one embodiment, at least a portion of the vest body 105 can be made of any type of woven materials, non-woven materials, molded materials, man-made materials, natural materials, or combinations thereof. For example, the vest body 105 can include mesh materials, moisture-wicking materials, foam materials, rubber materials (e.g., polyamides, polychloroprenes, polyesters, or the like), cotton materials, rayon materials, spandex materials, metal wires, etc.

Figure 2:
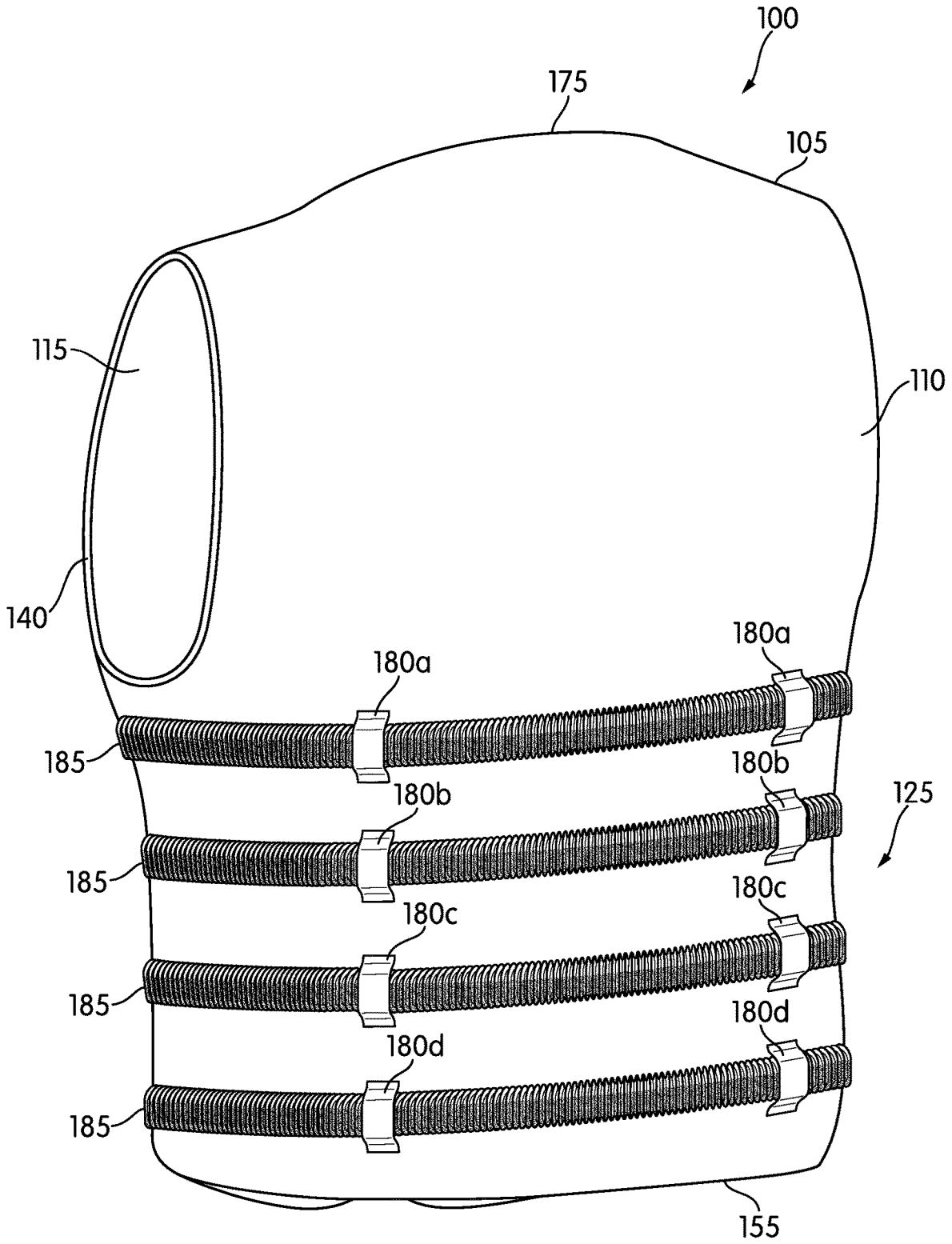
FIG. 2 is a rear perspective view of the weighted garment of FIG. 1.

With reference to FIGS. 1 and 2, the vest body 105 also includes an attachment mechanism 180 coupled to the outer surface 110 of the vest body 105. The illustrated attachment mechanism 180 includes four series of discrete loops 180*a*, 180*b*, 180*c*, 180*d* with at least one loop 180*a*, 180*b*, 180*c*, 180*d* coupled to the right front portion 120, at least one loop 180*a*, 180*b*, 180*c*, 180*d* coupled to the back portion 125, and at least one loop 180*a*, 180*b*, 180*c*, 180*d* coupled to the left front portion 130. In one embodiment, each loop 180*a*, 180*b*, 180*c*, 180*d* is a resilient loop that is biased toward the outer surface 110 once each loop 180*a*, 180*b*, 180*c*, 180*d* is expanded away from the outer surface 110 of the vest body 105. In other embodiments, the vest body 105 can include more or less than four series of loops 180*a*, 180*b*, 180*c*, 180*d*. In further embodiments, the series of loops 180*a*, 180*b*, 180*c*, 180*d* can be replaced with a different attachment mechanism (e.g., hook and loop fasteners, buckles, clasps, tracks, etc.).

Figure 3:
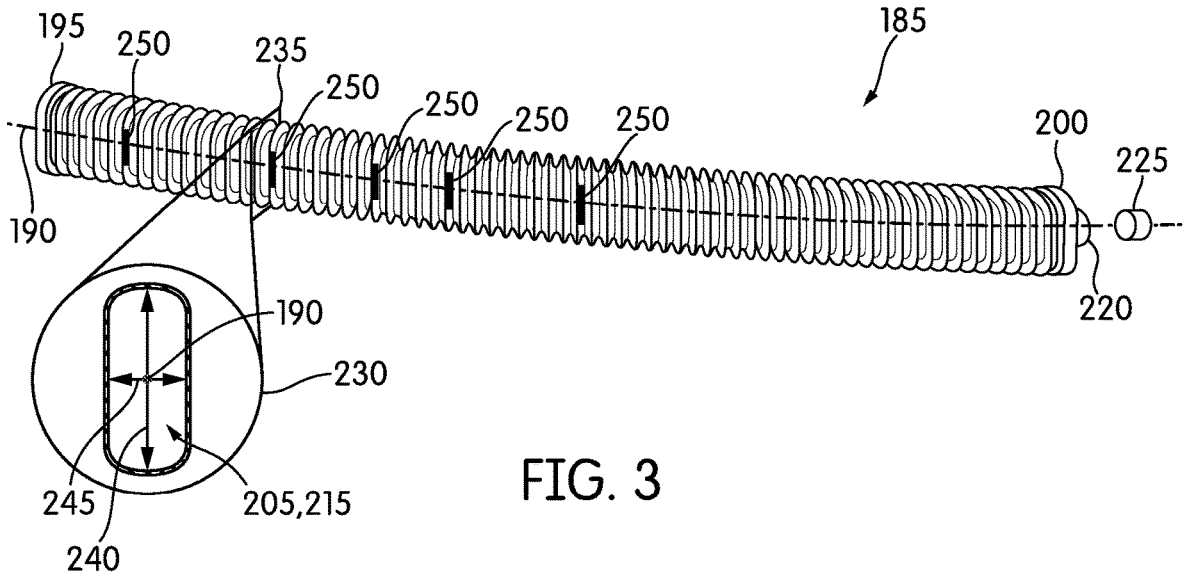
FIG. 3 is a perspective view of one of a plurality of flexible tubes coupled to the weighted garment of FIG. 1 illustrating a cross sectional profile of the one of the plurality of flexible tubes.
Figure 4:
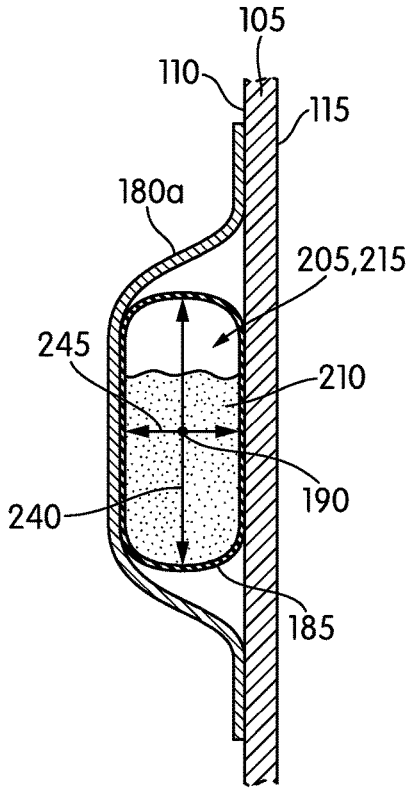
FIG. 4 is a cross sectional view of a portion of the weighted garment taken along line 4-4 of FIG. 1 including a cross sectional profile of one of the plurality of flexible tubes including a liquid.

The illustrated garment 100 also includes a plurality of flexible tubes 185 (one of the tubes 185 is shown in FIG. 3) with each tube 185 selectively and independently coupled to the vest body 105 via the attachment mechanism 180, as discussed in more detail below. With reference to FIG. 3, each tube 185 defines a central longitudinal axis 190 extending between first and second ends 195, 200 of each tube 185 and an inner cavity 205 configured to receive a liquid 210 (FIG. 4). In the illustrated embodiment, the liquid 210 is water, but in other embodiments, the liquid 210 can be at least partially water, alcohol, or the like. The inner cavity 205 of each tube 185 defines a volume 215 with each tube 185 sized to include the same volume. In other embodiments, the tubes 185 can be sized differently so that the volume 215 of one tube 185 is different than a volume 215 of another tube 185. In the illustrated embodiment, the first end 195 of each tube 185 is a closed end and the second end 200 includes an inlet 220 providing access to the inner cavity 205 with a stopper 225 (e.g., cap, valve, or the like) selectively covering the inlet 220 to block access to the inner cavity 205. In other embodiments, both ends 195, 200 can include the inlet 220, and/or the inlet 220 can be positioned between the ends 195, 200. In further embodiments, both ends 195, 200 can be closed after the liquid 210 is received within the tubes 185. As best shown in FIG. 3, each illustrated tube 185 is corrugated along an entire length of each tube 185, but in other embodiments, only portion(s) of each tube 185 can be corrugated. In further embodiments, one or more of the tubes 185 is not corrugated and/or not flexible (e.g., rigid). Also, each tube 185 defines a cross sectional profile 230 in a plane 235 perpendicular to the central longitudinal axis 190. In the illustrated embodiment, the cross sectional profile 230 is substantially rectangular having curved edges to define a major dimension 240 perpendicular to a minor dimension 245 with the major dimension 240 being greater than the minor dimension 245. In other embodiments, the cross sectional profile 230 can be circular, ovular, tear-drop shaped, eye shaped, hexagonal, triangular, etc. In further embodiments, different tubes 185 can include different cross sectional profiles, and/or the same tube 185 can include different cross sectional profiles at different portions along the longitudinal axis 190. In one embodiment, an area of the cross sectional profile 230 is between about 0.05 inches squared and about 10 inches squared. In other embodiments, an area of the cross sectional profile 230 is between about 0.2 inches squared and about 5 inches squared. In one embodiment, each tube 185 can be made from plastic, rubber (e.g., silicon rubber), or the like and/or include coatings that are anti-microbial, anti-fungal, biocidal, self-cleaning, hydrophobic or superhydrophobic, oleophobic, superoleophobic, or the like.

With continued reference to FIG. 3, each tube 185 also includes indicia 250 positioned along the central longitudinal axis 190 with each indicium 250 representing a weight of each tube 185 that corresponds to an amount of the liquid 210 within each tube 185. The illustrated indicia 250 are oriented substantially perpendicular to the central longitudinal axis 190. In other embodiments, the indicia 250 can be oriented substantially parallel to the central longitudinal axis 190. In order to fill each tube 185 with a desired amount of liquid 210, each tube 185 is oriented vertically for the liquid 210 to enter the inlet 220 and fall downwardly towards the closed end 195. In one embodiment, the flexible tubes 185 include sufficient rigidity so that the tubes 185 do not expand in a direction along the central longitudinal axis 190 as the liquid 210 fills the tubes 185. As a result, the liquid 210 can be accurately filled up to the desired indicium 250 and an accurate weight of each tube 185 can be obtained. In other embodiments, the closed end 195 can be supported on a surface as the liquid 210 is filled to the desired indicium 250 to ensure each tube 185 does not expand in the direction along the central longitudinal axis 190. In one embodiment, the indicia 250 can represent a weight of each tube 185 between about 0.1 pounds and about 10 pounds. In other embodiments, the indicia 250 can represent a weight of each tube 185 between about 0.5 pounds and about 5 pounds. In further embodiments, the indicia 250 can represent a volume of an amount of the liquid 210 within each tube 185. In yet further embodiments, each tube 185 can include different indicia 250 that correspond to different liquids 210 that can be received within each tube 185 (e.g., the different indicia 250 can account for different densities of different liquids).

Furthermore, the tubes 185 also include sufficient rigidity so that the cross sectional profile 230 of each tube 185 remains substantially unchanged between when the tube is empty (FIG. 3) and when a desired amount of liquid 210 is received within each tube 185 (FIG. 4). In other words, each tube 185 does not expand within the plane 235 when filled with the liquid 210. In the illustrated embodiment, the desired amount of liquid 210 within each tube 185 is between about 40 percent and about 80 percent of the total volume 215 of each tube 185. As such, the liquid 210 can move and slosh around within the tubes 185 during use, as discussed in more detail below. In other embodiments, the remaining volume 215 of each tube 185 can be pressurized with a gas (e.g., air, nitrogen, etc.) to provide additional structural stability of each tube 185 once the liquid 210 is introduced.

With reference to FIGS. 1, 2, and 4, once the tubes 185 are filled to their desired weight, each tube 185 is coupled to the attachment mechanism 180 of the vest body 105 so that the central longitudinal axis 190 of each tube 185 is substantially parallel to the other tubes 185. In addition, the weight of each tube 185 collectively defines a desired total weight of the garment 100. In one embodiment, the total weight of the garment 100 can be between about 0.25 pounds and about 40 pounds. In particular, each tube 185 is coupled to the attachment mechanism 180 by inserting each tube 185 through any one of the series of loops 180*a*, 180*b*, 180*c*, 180*d* so that each tube 185 continuously extends from the right side portion 120 around the back portion 125 to the left side portion 130 of the vest body 105. As such, each tube 185 partially extends around the torso 145 of the person (e.g., a gap is formed between the ends 195, 200 of each tube 185; FIG. 1). In other embodiments, each tube 185 can fully extend around the torso 145 so that the gap between the ends 195, 200 does not exist. In further embodiments, the ends 195, 200 can be connected together to inhibit the tubes 185 from sliding out of the attachment mechanism 180. As best shown in FIG. 4, the loops 180*a*, 180*b*, 180*c*, 180*d* bias each tube 185 against a portion of the outer surface 110 to secure the tubes 185 to the vest body 105. In other embodiments, the attachment mechanism 180 can be fixedly coupled to the tubes 185 for the attachment mechanism 180 to be selectively coupled to the vest body 105, for example, by hook and loop fasteners, buckles, clasps, etc.

In use, a person wears the garment 100 while exercising (e.g., body-weight exercises, rehabilitation exercises, athletic training exercises, physical therapy exercises, balancing exercises, etc.) to increase the efficiency of the exercise. In particular, the liquid 210 within the partially filled tubes 185 is allowed to move within the tubes 185 to engage particular muscle groups of the person to counteract the movement/momentum of the liquid 210. In one embodiment, the primary muscle groups that are engaged while wearing the garment 100 are the muscle groups within and adjacent the torso 145 in which the tubes 185 surround. For example, during a torso exercise, at least one of the Rectus Abdominis, the External Obliques, the Internal Obliques, the Transverse Abdominis, the Iliocostalis, the Longissimus, the Spinalis, the Semispinalis, the Quadratus Lumborum, the Multifidi, the Rotatores, etc. muscle groups can be engaged while wearing the garment 100.

The illustrated tubes 185 are selectively and independently coupled to the vest body 105 so that each tube 185 can be cleaned, sterilized, etc. after the exercise. Also, each tube 185 can be removed from the vest body 105 to change the weight of each tube 185, which ultimately provides customization of the total garment 100 resistance and weight.

In other embodiments, the garment 100 can include electronics such as a stop watch, heart rate monitor, oxygen monitor, steps taken monitor, distance travelled monitor, calorie burned monitor, active minutes monitor, alarm system, and/or include a display illustrating progress in charts and/or graphs. The garment 100 can also communicate with other electronic devices (e.g., smartphones, computers, etc.) to transfer information therebetween, in real time or after the fact.

The illustrated garment 100 will be subject to a plurality of studies to assist in assessing the effectiveness of the garment 100 in different scenarios. Examples of such studies are described below.

An Isolated Activation Model study will quantify the enhanced level of activation of the core trunk muscle that occurs with the garment 100 during quasi-stationary exercises. The muscles of the core are an essential component of many injury rehabilitation protocols, training programs, and, specifically, preventing low back pain. This study will identify the improved muscle activation that occurs with the garment 100 during exemplar exercises. A total of ten healthy individuals will perform a series of fundamental exercises that isolate the role of the key core muscles. The exercises will range from simple (e.g., Bird Dog, etc.) to progressively more complex (e.g., Lunge Twists, Wood Choppers, Single Leg RDL, etc.). Participants will perform each exercise five times in a total of three sets where each set will represent a different condition (e.g., body weight, traditional weight vest, fluid filled vest, etc.). Adequate rest in between exercises and sets will be provided to avoid muscle fatigue. Participants will be allowed sufficient practice repetitions to become competent with performing each exercise. A Noraxon Telemetry Surface Electromyography (EMG) system will be used to record and quantify muscle activation of key muscle surrounding the trunk and hips (e.g., rectus abdominis, external oblique, longissimus thoracis, lumbar multifidus, and gluteus medius, etc.). Peak and mean EMG amplitude will be calculated for each exercise and used to quantify the muscle activation differences across conditions (e.g., body weight, traditional weight vest, fluid vest, etc.). These results will establish activation enhancements that occur with the fluid filled vest in exercises that isolate the muscles targeted by the vest.

An Activities of Daily Living Model study will examine the influence of the garment 100 on muscle activation during a walking activity. Walking is a key component of many activities of daily living (ADL). It is possible that the garment 100 could enhance the activation of muscles associated with walking, thereby, proving to be a valuable rehabilitation or training tool for individuals where improving ADL's will improve function or quality of life. A total of ten healthy individuals will complete a five minute bout of walking on a treadmill at a pace of approximately 3.3 to 3.5 mph and an incline of 1.0%. Participants will repeat the walking task three times, once for each condition (e.g., body weight, traditional weight vest, fluid vest, etc.). A Noraxon Telemetry Surface Electromyography (EMG) system will be used to record and quantify muscle activation of key muscle surrounding the trunk and hips (e.g., rectus abdominis, external oblique, longissimus thoracis, lumbar multifidus, and gluteus medius, etc.) as well as those of the lower extremities (e.g., hamstrings, gastrocnemius, etc.). Peak EMG amplitude will be calculated during one complete gait cycle to quantify the muscle activation differences across conditions (e.g., body weight, traditional weight vest, fluid vest, etc.).

A factor in many injuries as well as in subsequent rehabilitation and prevention programs is balance. Current clinical practice alters the surface a person stands on to create a greater balance challenge for a person. The garment 100 challenges this concept by applying the load and perturbation to the balance system above the joint (e.g., the ankle, etc.) versus below the joint as seen surface changes. A Balance Model study will examine the influence of the garment 100 on muscle activation and balance performance (e.g., counteracting the force associated with momentum transfer of the fluid 210 in the tubes 185) during performance of a commonly used single leg balance exercise, the Y-Balance Task (YBT). A total of ten healthy individuals will perform three trials of the YBT on each leg with adequate rest between trials to avoid fatigue. Participants will repeat the walking task three times, once for each condition conditions (e.g., body weight, traditional weight vest, fluid vest, etc.). A Noraxon Telemetry Surface Electromyography (EMG) system will be used to record and quantify muscle activation of key muscle surrounding the trunk and hips (e.g., rectus abdominis, external oblique, longissimus thoracis, lumbar multifidus, and gluteus medius, etc.) as well as those of the lower extremities (e.g., hamstrings, gastrocnemius, etc.). Peak and mean EMG amplitude will be calculated to quantify the muscle activation differences across conditions (e.g., body weight, traditional weight vest, fluid vest, etc.). In addition, total reach distance will be measured (in inches, centimeters, etc.) to determine balance performance.

Figure 5:
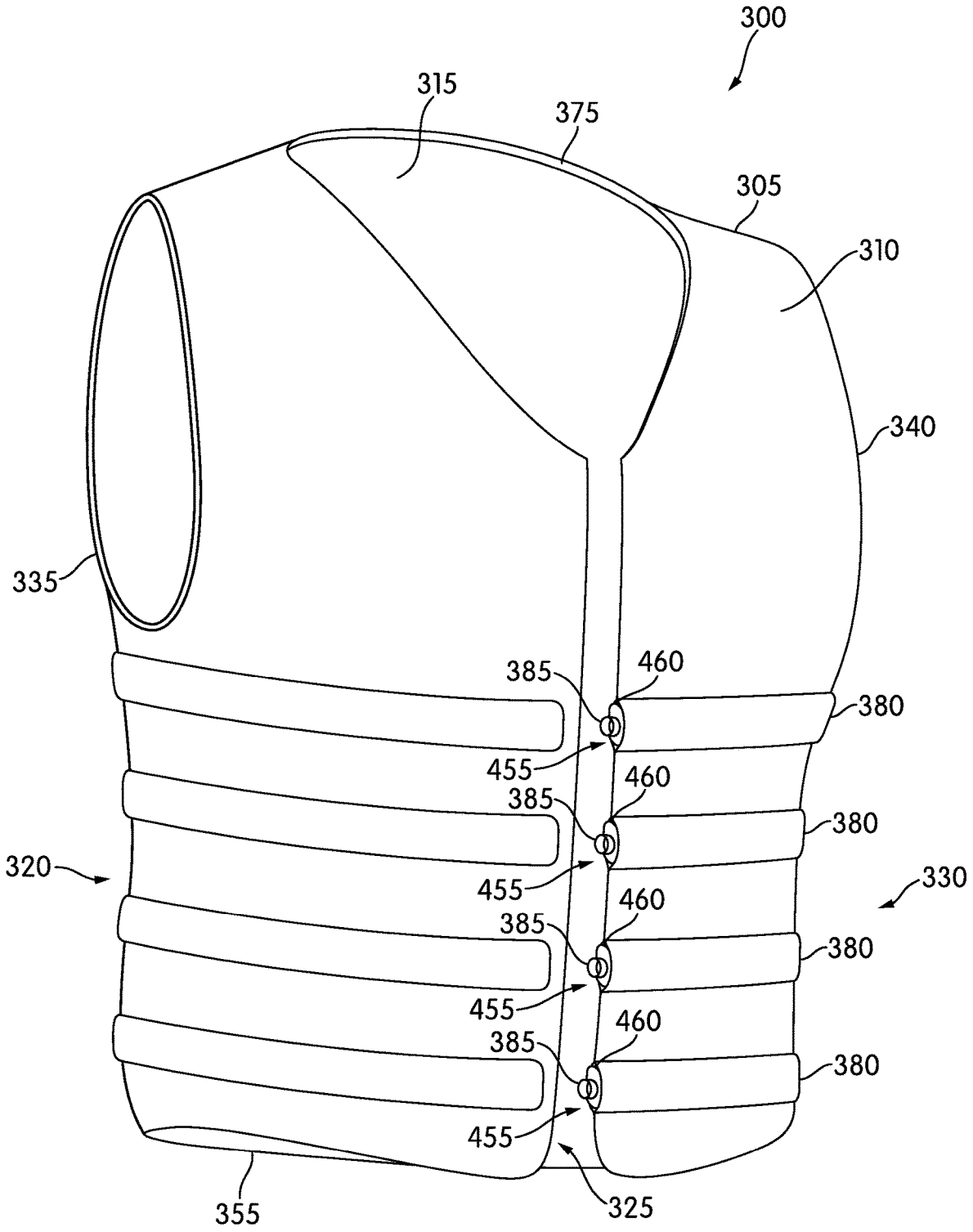
FIG. 5 is a perspective view of a weighted garment wearable about a torso of a person according to another embodiment of the disclosure.

FIG. 5 illustrates a garment 300 according to another embodiment. The garment 300 is similar to the garment 100 illustrated in FIGS. 1-4; therefore, similar components are designated with similar references numbers plus 200, and only the differences between the garments 100, 300 will be discussed in detail. In addition, components or features described with respect to only one or some of the embodiments described herein are equally applicable to any other embodiments described herein.

The illustrated garment 300 (i.e., a weighted vest) includes a vest body 305 having an outer surface 310 and an inner surface 315 defining a right front portion 320, a back portion 325, and a left front portion 330. The vest body 305 also includes a right arm opening 335, a left arm opening 340, a lower torso opening 355, and a neck opening 375. An attachment mechanism 380 in the form of a plurality of continuous channels 455 is formed between the outer surface 310 and the inner surface 315 of the vest body 305. Each channel 455 slidably receives any one of a plurality of flexible tubes 385 through an opening 360 of each channel 455 to couple each tube 385 to the vest body 305. As such, the plurality of tubes 385 are substantially concealed within the plurality of continuous channels 455. In one embodiment, a flap can selectively cover the opening 460 (e.g., by hook and loop fasteners) to inhibit the tubes 385 from sliding out of the channels 455. In other embodiments, both ends of each channel 455 can include the opening 460.

Figure 6:
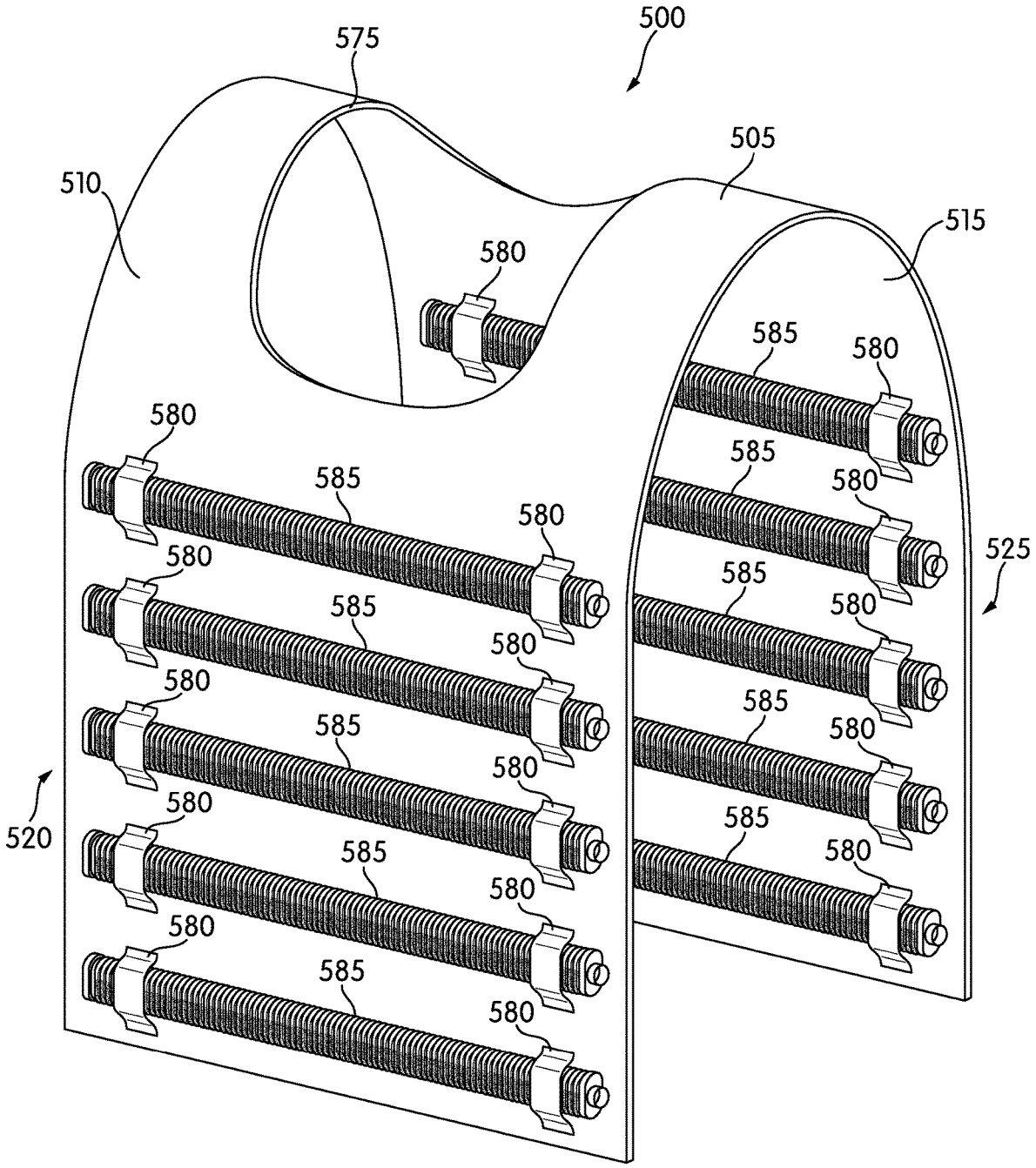
FIG. 6 is a perspective view of a weighted garment wearable about a torso of a person according to another embodiment of the disclosure.
Figure 7:
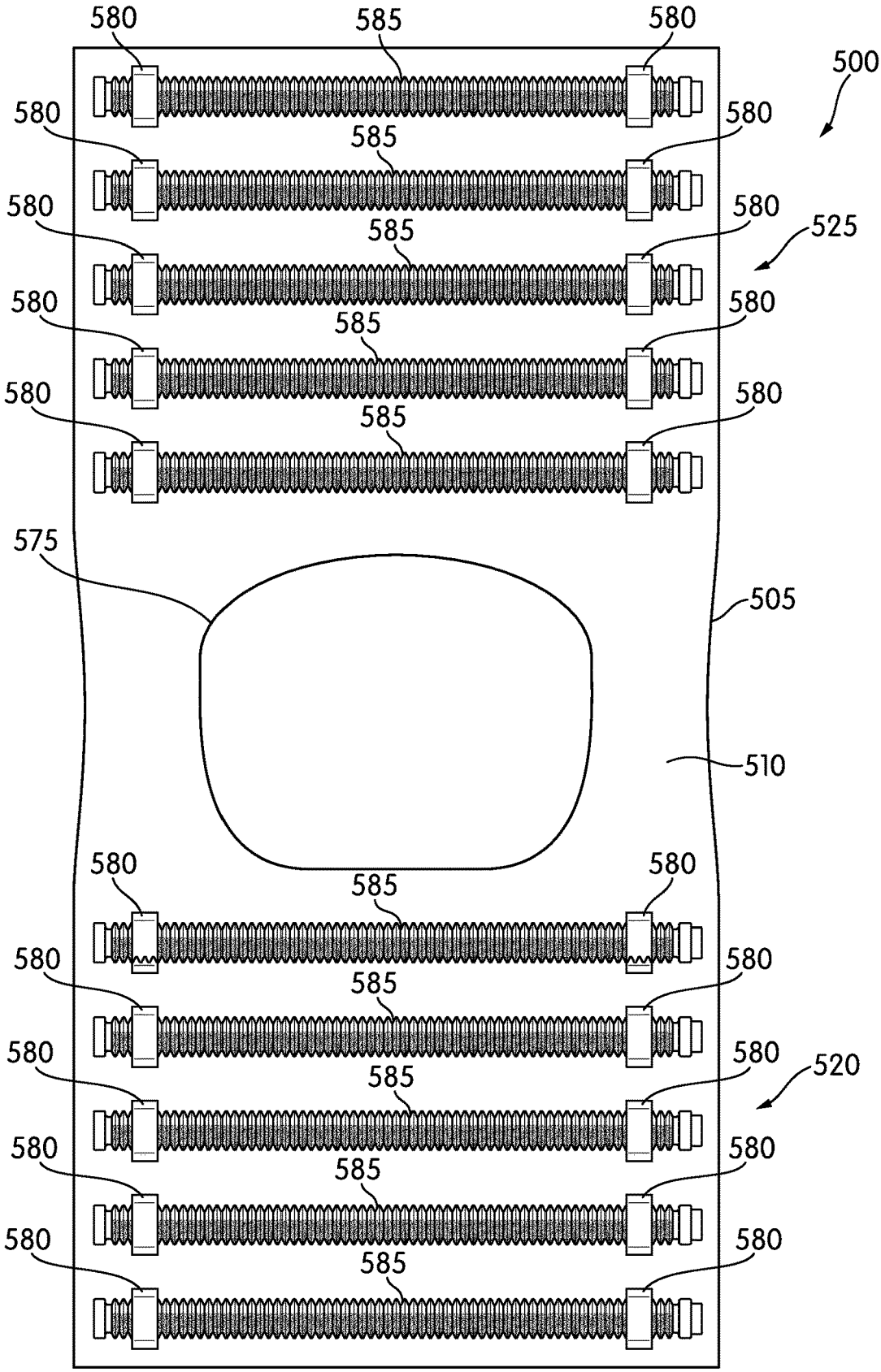
FIG. 7 is a plane view of the weight garment of FIG. 6.

FIGS. 6 and 7 illustrate a garment 500 according to another embodiment. The garment 500 is similar to the garment 100 illustrated in FIGS. 1-4; therefore, similar components are designated with similar references numbers plus 400, and only the differences between the garments 100, 500 will be discussed in detail. In addition, components or features described with respect to only one or some of the embodiments described herein are equally applicable to any other embodiments described herein.

The illustrated garment 500 (i.e., a weighted vest) includes a vest body 505 having an outer surface 510 and an inner surface 515 defining a front portion 520 and a back portion 525. The vest body 505 also includes a neck opening 575 but does not include distinct arm openings as does the garment 100 of FIG. 1. The vest body 505 also includes an attachment mechanism 580 coupled to the outer surface 510 of the front portion 520 and to the inner surface 515 of the back portion 525. As such, the attachment mechanism 580 couples a plurality of flexible tubes 585 to the outer surface 510 and the inner surface 515 of the vest body 505. In other embodiments, the attachment mechanism 580 can be coupled to the outer surface 510 and/or the inner surface 515 of the front portion 520, and/or the attachment mechanism 580 can be coupled to the outer surface 510 and/or the inner surface 515 of the back portion 525. In some embodiments, the vest body 505 can include straps opposite the neck opening 575 on opposing sides of the vest body 505 to selectively couple the front portion 520 to the back portion 525 to help secure the garment 500 to a person.

Figure 8:
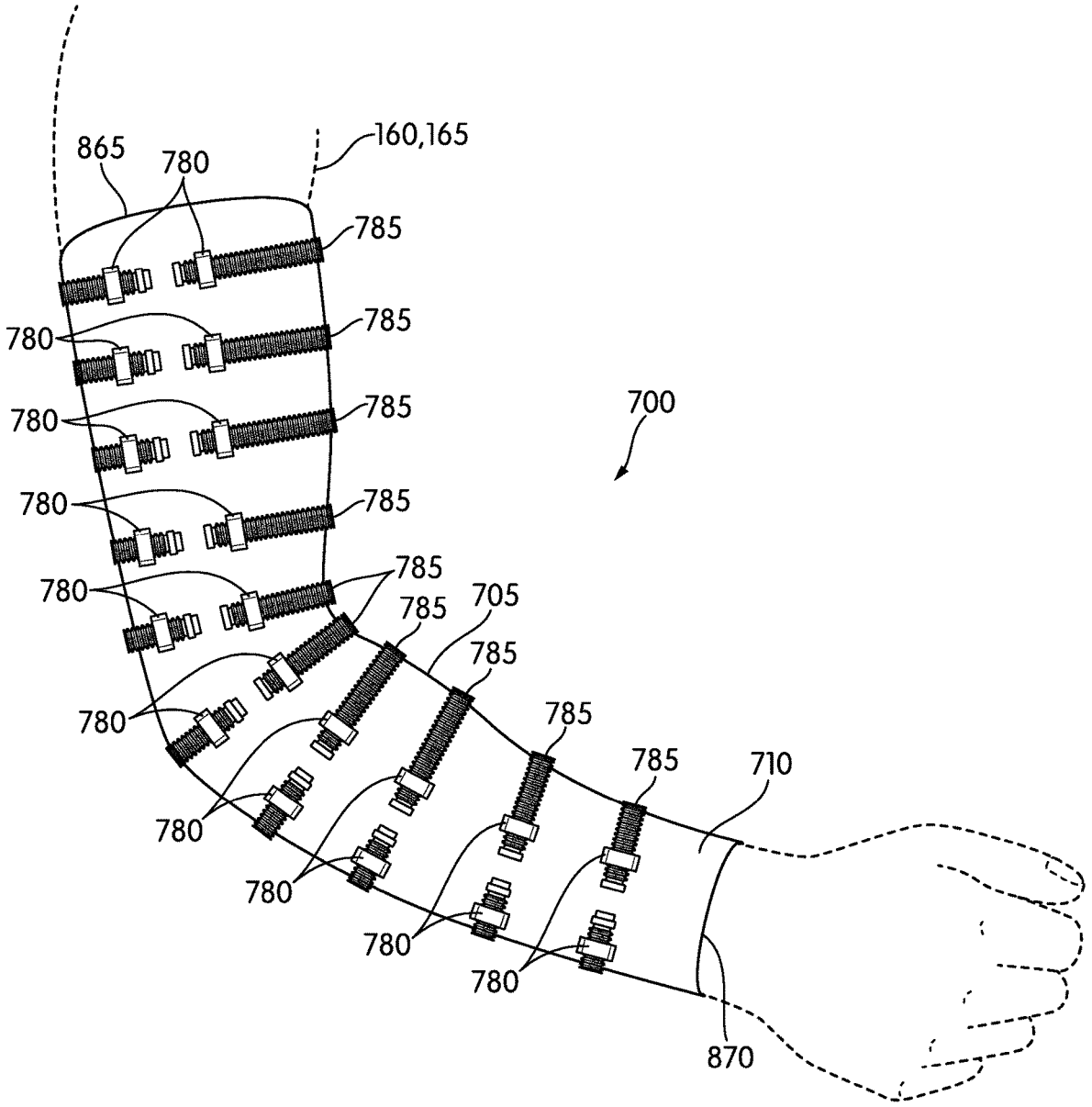
FIG. 8 is a perspective view of a weighted garment wearable about an arm of a person according to another embodiment of the disclosure.

FIG. 8 illustrates a garment 700 according to another embodiment. The garment 700 is similar to the garment 100 illustrated in FIGS. 1-4; therefore, similar components are designated with similar references numbers plus 600, and only the differences between the garments 100, 700 will be discussed in detail. In addition, components or features described with respect to only one or some of the embodiments described herein are equally applicable to any other embodiments described herein.

The illustrated garment 700 (i.e., a weighted arm sleeve) includes a body 705 having two opposing openings 865, 870 sized to slide over the right arm 160 or the left arm 165 of a person. In the illustrated embodiment, the garment 700 generally extends from a bicep of the arm 160, 165 to a wrist of the arm 160, 165. In other embodiments, the garment 700 can generally extend from the bicep of the arm 160, 165 to an elbow of the arm 160, 165, or the garment 700 can generally extend from the elbow of the arm 160, 165 to the wrist of the arm 160, 165. The garment 700 also includes an attachment mechanism 780 coupled to an outer surface 710 of the body 705. As such, the attachment mechanism 780 couples a plurality of flexible tubes 785 to the outer surface 710 of the body 705. In other embodiments, the tube 785 extending over the elbow of the arm 160, 165 can be omitted to increase the flexibility of the garment 700 as a person bends their arm 160, 165.

In one embodiment, the primary muscle groups that are engaged while wearing the garment 700 are the muscle groups within and adjacent the arm 160, 165 in which the tubes 785 surround. For example, during an arm exercise, at least one of the Upper Trapezius, the Levator Scapula, the Pectoralis Minor, the Lower Trapezius, the Serratus Anterior, the Middle Trapezius, the Rhomboids, the Anterior Deltoid, the Pectoralis Major, the Subscapularis, the Teres Major, the Latissimus Dorsi, the Infraspinatus, the Teres Minor, the Posterior Deltoid, the Biceps Brachii, the Triceps Brachii, the Supraspinatus, the Middle Deltoid, the Pectoralis, the Coracobrachialis, the Latissimus Dorsi, etc. muscle groups can be engaged while wearing the garment 700.

Figure 9:
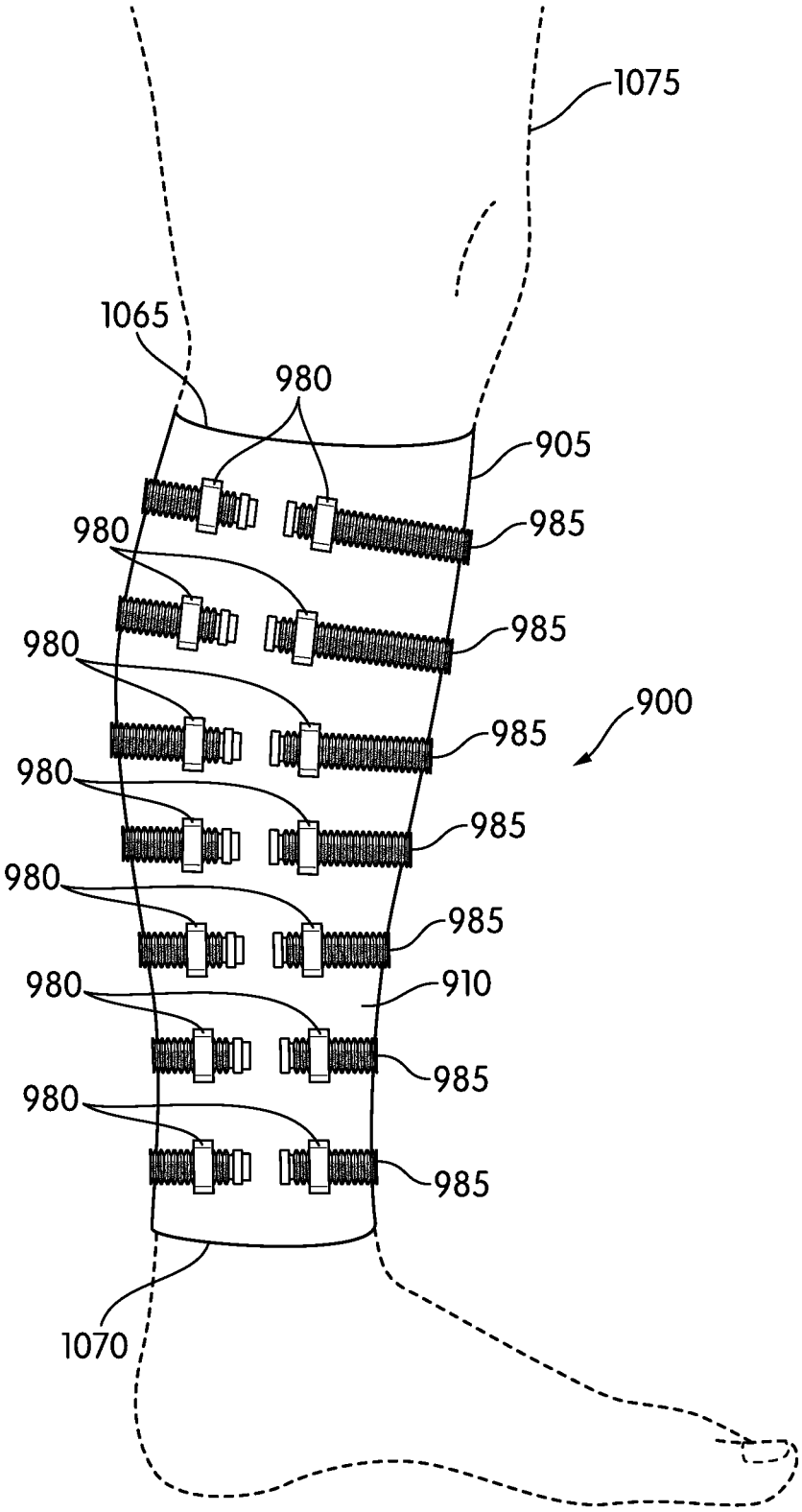
FIG. 9 is a perspective view of a weighted garment wearable about a leg of a person according to another embodiment of the disclosure.

FIG. 9 illustrates a garment 900 according to another embodiment. The garment 900 is similar to the garment 100 illustrated in FIGS. 1-4; therefore, similar components are designated with similar references numbers plus 800, and only the differences between the garments 100, 900 will be discussed in detail. In addition, components or features described with respect to only one or some of the embodiments described herein are equally applicable to any other embodiments described herein.

The illustrated garment 900 (i.e., a weighted leg sleeve) includes a body 905 having two opposing openings 1065, 1070 sized to slide over a leg 1075 of a person. In the illustrated embodiment, the garment 900 generally extends from a knee of the leg 1075 to an ankle of the leg 1075. In other embodiments, the garment 900 can generally extend from a thigh of the leg 1075 to the knee of the leg 1075, or the garment 900 can generally extend from the thigh of the leg 1075 to the ankle of the leg 1075. The garment 900 also includes an attachment mechanism 980 coupled to an outer surface 910 of the body 905. As such, the attachment mechanism 980 couples a plurality of flexible tubes 985 to the outer surface 910 of the body 905.

In one embodiment, the primary muscle groups that are engaged while wearing the garment 900 are the muscle groups within and adjacent the leg 1075 in which the tubes 985 surround. For example, during a leg exercise, at least one of the Piriformis, the Gemellus Superior, the Obturator Internus, the Gemellus Inferior, the Obturator Externus, the Quadratus Femoris, the Gluteus Maximus, the Sartorius, the Gluteus Medius, the Gluteus Minimus, the Tensor Fascia Latae, the Adductor Magnus, the Psoas Major, the Iliacus, the Pectineus, Adductor Brevis, the Adductor Longus, the Rectus Femoris, the Biceps Femoris, the Semitendinosus, the Semimembranosus, the Gracilis, the Pectineus etc. muscle groups can be engaged while wearing the garment 900.

Figure 10:
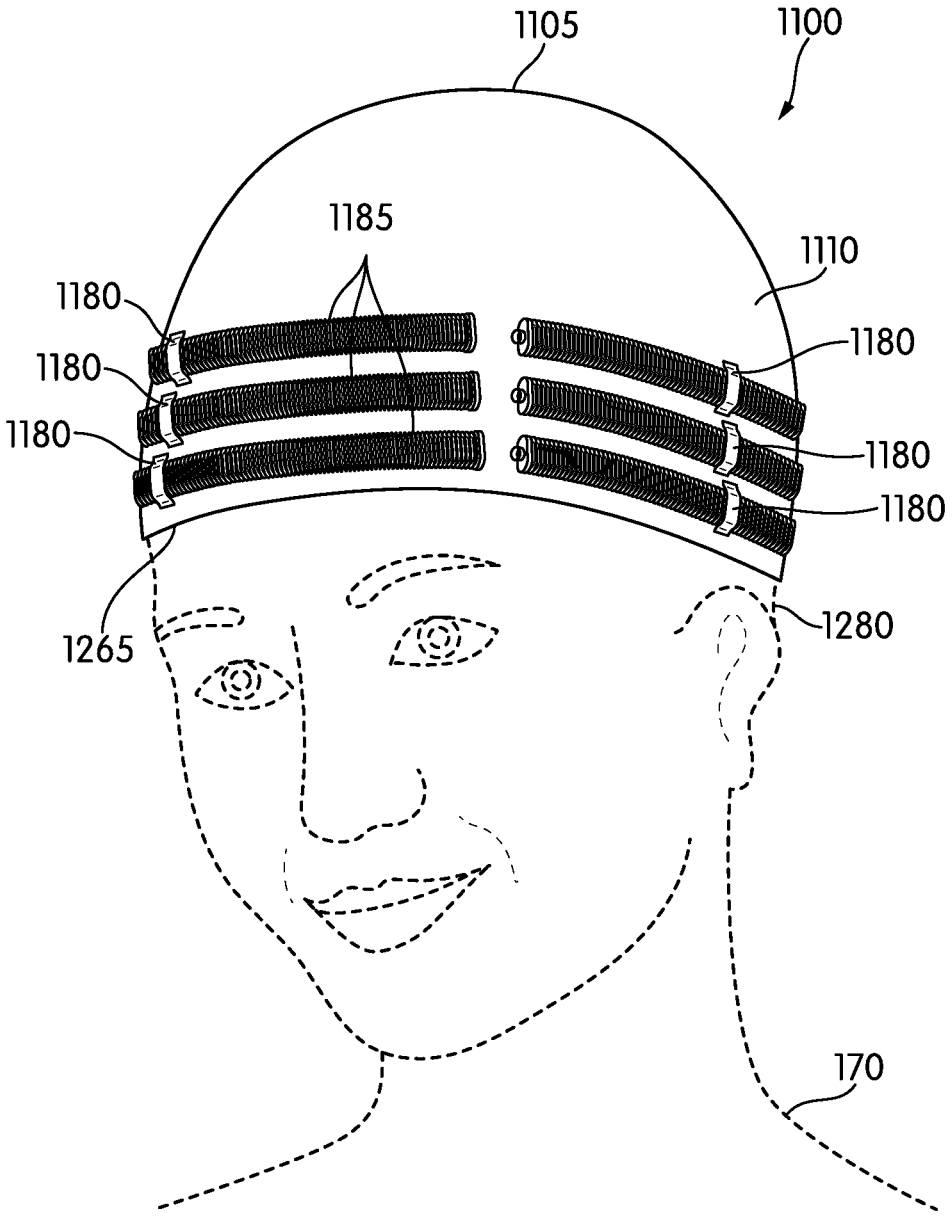
FIG. 10 is a perspective view of a weighted garment wearable on a head of a person according to another embodiment of the disclosure.

FIG. 10 illustrates a garment 1100 according to another embodiment. The garment 1100 is similar to the garment 100 illustrated in FIGS. 1-4; therefore, similar components are designated with similar references numbers plus 1000, and only the differences between the garments 100, 1100 will be discussed in detail. In addition, components or features described with respect to only one or some of the embodiments described herein are equally applicable to any other embodiments described herein.

The illustrated garment 1100 (i.e., weighted headwear) includes a body 1105 having an opening 1265 sized to receive a head 1280 of a person. In some embodiments, the headwear 1100 can include a cap, a hat, a headband, etc. The garment 1100 also includes an attachment mechanism 1180 coupled to an outer surface 1110 of the body 1105. As such, the attachment mechanism 1180 couples a plurality of flexible tubes 1185 to the outer surface 1110 of the body 1105.

In one embodiment, the primary muscle groups that are engaged while wearing the garment 1100 are the muscle groups within and adjacent the neck 170. For example, during a neck exercise, at least one of the SternalCleido-Mastoid, the Scalenes, the Longus Colli, the Splenius Capitus, the Splenius Cervicis, the Upper Trapezius, etc. muscle groups can be engaged while wearing the garment 1100.

While the garments 100, 300, 500, 700, 900, 1100 are illustrated as having a particular number of flexible tubes 185, 385, 585, 785, 985, 1185, in some embodiments, the attachment mechanisms 180, 380, 580, 780, 980, 1180 can secure any number of flexible tubes 185, 385, 585, 785, 985, 1185 to the corresponding body 105, 305, 505, 705, 905, 1105. In addition, the attachment mechanisms 180, 380, 580, 780, 980, 1180 can be at least one of or a combination of resilient loops, non-resilient loops, hook and loop fasteners, buckles, clasps, tracks, etc. to secure the flexible tubes 185, 385, 785, 985, 1185 to the corresponding body 105, 305, 505, 705, 905, 1105.

Although the disclosure has been described in detail with reference to certain preferred embodiments, variations and modifications exist within the scope and spirit of one or more independent aspects of the disclosure as described. Various features and advantages of the disclosure are set forth in the following claims.

The invention claimed is:

1. A garment comprising:

a garment body configured to be wearable by a person, the garment body including a right front portion, a left front portion, and a back portion forming a torso portion of the garment body and a neck opening, the neck opening configured to receive a neck of the person wearing the garment, the right front portion and the back portion forming an enclosed right arm opening configured to receive a right arm of the person wearing the garment, the left front portion and the back portion forming an enclosed left arm opening configured to receive a left arm of the person wearing the garment;

a plurality of loops coupled to the torso portion of the garment body;

a first tube selectively coupled to the garment body by sliding the first tube through at least a first loop of the plurality of loops such that the first tube is positioned below the right arm opening and the left arm opening, the first tube configured to receive a first desired amount of liquid through a first opening of the first tube, the first opening located at an end of the first tube;

a second tube selectively coupled to the garment body by sliding the second tube at least a second loop of the plurality of loops independently of the first tube, the second tube positioned below the right arm opening and the left arm opening, the second tube configured to receive a second desired amount of liquid through a second opening of the second tube, the second opening located at an end of the second tube, the second tube being fluidly distinct from the first tube;

a third tube selectively coupled to the garment body by sliding the third tube through at least a third loop of the plurality of loops independently of the first and second tubes, the third tube positioned below the right arm opening and the left arm opening, the third tube configured to receive a third desired amount of liquid through a third opening of the third tube, the third opening located at an end of the third tube, the third tube being fluidly distinct from the first and second tubes; and a fourth tube selectively coupled to the garment body by sliding the fourth tube through at least a fourth loop of the plurality of loops independently of the first, second, and third tubes, the fourth tube positioned below the right arm opening and the left arm opening, the fourth tube configured to receive a fourth desired amount of liquid through a fourth opening of the fourth tube, the fourth opening located at an end of the fourth tube, the fourth tube being fluidly distinct from the first, second, and third tubes;

wherein a total weight of the garment is adjustable to weigh up to 40 pounds dependent on an aggregate liquid amount including the first desired amount of liquid, the second desired amount of liquid, the third desired amount of liquid, and the fourth desired amount of liquid.

2. The garment of claim 1, wherein the first tube defines a first central longitudinal axis and the second tube defines a second central longitudinal axis, and wherein the first central longitudinal axis is substantially parallel to the second central longitudinal axis when the first and second tubes are coupled to the garment body.

3. The garment of claim 2, wherein the first tube defines a cross sectional profile perpendicular to the first central longitudinal axis, and wherein the cross sectional profile is substantially unchanged between when the first desired amount of liquid is received within the first tube and when the first tube is empty.

4. The garment of claim 1, wherein the first tube defines a first volume and the second tube defines a second volume, and wherein the first and second volumes are substantially the same.

5. The garment of claim 1, wherein the garment body defines a vest configured to be worn at least partially around a torso of the person.

6. The garment of claim 1, wherein the first, second, third, and fourth tubes are coupled to an outer surface of the garment body.

7. The garment of claim 1, wherein the first, second, third, and fourth tubes are coupled to an inner surface of the garment body.

8. The garment of claim 1, wherein the first tube is a first corrugated tube, wherein the second tube is a second corrugated tube, wherein the third tube is a third corrugated tube, and wherein the fourth tube is a fourth corrugated tube.

9. The garment of claim 8, wherein the first tube defines a cross sectional profile perpendicular to a central longitudinal axis of the first tube, and wherein the cross sectional profile defines a minor dimension and a major dimension, and wherein the major dimension is substantially parallel to a surface of the garment body in contact with the first tube.

10. The garment of claim 1, wherein the first, second, third, and fourth tubes each include indicia, and wherein each indicia represents a weight of the respective first, second, third, and fourth tubes when the first, second, third, and fourth tubes are filled with a liquid to each indicia.

11. The garment of claim 1, wherein the garment body includes an upper portion having the right front portion, the left front portion, and the back portion above the right arm opening and the left arm opening, and wherein the upper portion of the garment body is free of loops.

12. A garment configured to be wearable by a person, the garment comprising:

a vest body including a right front portion, a left front portion, and a back portion, the right front portion and the back portion forming an enclosed right arm opening configured to receive a right arm of the person wearing the garment, the left front portion and the back portion forming an enclosed left arm opening configured to receive a left arm of the person wearing the garment, an upper portion including the right front portion, the left front portion, and the back portion above the right arm opening and the left arm opening, and a lower portion including the right front portion, the left front portion, and the back portion below the right arm opening and the left arm opening;

four tube attachment mechanisms coupled to the lower portion of the vest body such that all of the four tube attachment mechanisms are positioned below the right arm opening and the left arm opening, the upper portion of the vest body being free of tube attachment mechanisms;

a first flexible tube coupled to the vest body by a first tube attachment mechanism of the four tube attachment mechanisms, the first flexible tube extending from the right front portion across the back portion to the left front portion of the vest body, the first flexible tube configured to receive a first desired amount of liquid through a first opening of the first flexible tube; and a second flexible tube coupled to the vest body by a second tube attachment mechanism of the four tube attachment mechanisms, the second flexible tube extending from the right front portion across the back portion to the left front portion of the vest body, the second flexible tube configured to receive a second desired amount of liquid through a second opening of the second flexible tube, the second flexible tube being fluidly distinct from the first flexible tube;

wherein the first flexible tube defines a first cross sectional profile perpendicular to a first central longitudinal axis of the first flexible tube, and wherein the first cross sectional profile is substantially unchanged between when the first desired amount of liquid is received within the first flexible tube and when the first flexible tube is empty; and wherein the second flexible tube defines a second cross sectional profile perpendicular to a second central longitudinal axis of the second flexible tube, and wherein the second cross sectional profile is substantially unchanged between when the second desired amount of liquid is received within the second flexible tube and when the second flexible tube is empty.

13. The garment of claim 12, wherein the first central longitudinal axis is substantially parallel to the second central longitudinal axis when the first and second flexible tubes are coupled to the vest body.

14. The garment of claim 12, further comprising a third flexible tube coupled to the vest body by a third tube attachment mechanism of the four tube attachment mechanisms, wherein the third flexible tube extends from the right front portion across the back portion to the left front portion of the vest body, and wherein the third flexible tube is configured to receive a third desired amount of liquid through a third opening of the third flexible tube.

15. The garment of claim 14, further comprising a fourth flexible tube coupled to the vest body by a fourth tube attachment mechanism of the four tube attachment mechanisms, wherein the fourth flexible tube extends from the right front portion across the back portion to the left front portion of the vest body, and wherein the fourth flexible tube is configured to receive a fourth desired amount of liquid through a fourth opening of the fourth flexible tube.

16. The garment of claim 15, wherein a total weight of the garment is adjustable to weigh up to 40 pounds dependent on an aggregate liquid amount including the first desired amount of liquid and the second desired amount of liquid.

* * * * *